US005299496A

United States Patent [19]

Martin et al.

[11] Patent Number: 5,299,496

[45] Date of Patent: Apr. 5, 1994

[54] WEN HANDLING APPARATUS HAVING IMPROVED IMAGE REGISTRATION SYSTEM AND METHOD

[76] Inventors: John R. Martin, 5635 Nebeshonee Dr., Rockford, Ill. 61103; Roger Cederholm, 10959 Hamborg Rd., Roscoe, Ill. 61073

[21] Appl. No.: 985,363

[22] Filed: Dec. 2, 1992

Related U.S. Application Data

[63] Continuation of Ser. No. 849,829, Mar. 11, 1992, abandoned, which is a continuation of Ser. No. 515,576, Apr. 27, 1990, abandoned.

[51] Int. Cl.[5] ..... B41F 5/06; B41F 13/02

[52] U.S. Cl. ..... 101/181; 101/228; 101/481

[58] Field of Search ..... 101/181, 211, 182, 228, 101/226, 248, 481; 226/29, 30, 34, 36

[56] References Cited

U.S. PATENT DOCUMENTS 3,329,087 7/1967 Sandor et al. ..... 101/181

3,472,161 10/1969 Farrer ..... 101/181

*Primary Examiner*—J. Reed Fisher

*Attorney, Agent, or Firm*—McAndrews, Held & Malloy, Ltd.

[57] ABSTRACT

Multi-station web handling apparatus having a pair of nip rolls at each station, where at least one of the rolls of each pair of nip rolls is deformed at the nip and having a print-to-print and/or cut-to-print image registration system and method that prevents image mis-register errors from occurring, as opposed to attempting to correct mis-register errors after they have occurred and have been sensed. Each of the stations includes a driven nip roll positioned upstream of and closely adjacent to the nip of the pair of nip rolls of the station. The rolls are driven at the same speed as the pairs of nip rolls at the stations are driven.

19 Claims, 3 Drawing Sheets

WEN HANDLING APPARATUS HAVING IMPROVED IMAGE REGISTRATION SYSTEM AND METHOD

This application is a continuation of application Ser. No. 07/849,829, filed Mar. 11, 1992, now abandoned, which was a continuation of application Ser. No. 07/515,576, filed Apr. 27, 1990, abandoned.

BACKGROUND OF THE INVENTION

The present invention relates to web handling apparatus having a system and method for controlling the print-to-print or cut-to-print registration of a series of regularly spaced, repeated images, printed on a moving web, as the web moves through a plurality of spaced apart stations that perform web handling operations, such as printing, cutting and the like, with respect to the images on the moving web. More particularly, the present invention relates to a print-to-print and/or cut-to-print registration system and method that may be used with a variety of web handling apparatus including especially a multi-station, web fed rotogravure printing press.

Gravure printing has been used for years and is recognized as being particularly useful for printing high quality, multi-colored images, such as found on commercial packaging, advertisements and the like, at relatively high speeds. In such multi-colored printing, images are printed in one color on a moving web at a first printing station and then the web passes through a drier section before proceeding to a second printing station where a second color is printed on the images. This printing and drying sequence is repeated at the various printing stations comprising the web-fed rotogravure printing press until a final, full color image is achieved. Some presses include a web cutting station as the last station in the press.

High quality multi-colored printing on web-fed rotogravure printing presses requires the maintenance of close registration between the adjacent images on the web. Failure to obtain this registration may result in a fuzzy or blurred image.

Even though the stations, including the printing stations, in rotogravure printing presses are mechanically linked so that the nipped rolls at each station are driven at the same speed, mis-register, as a practical matter, is a continuing problem with web-fed rotogravure printing presses. The art has long sought a simple, relatively inexpensive solution to image mis-register problems in rotogravure printing presses.

The previous systems used to minimize image mis-register in web fed rotogravure printing presses sought to sense errors in the relative positions of the images and then take steps to correct the sensed position errors as quickly as practicable. In other words, prior print-to-print and/or cut-to-print registration systems did not attempt to avoid mis-register of the images, but rather only sought to correct any mis-register after it had occurred and had been sensed.

Typically the prior systems sensed mis-register by sensing the relative positions of a series of marks printed on a side marginal edge of the moving web. This sensing required the use of spaced apart sensors positioned along the moving web as it passed through the printing press. The sensed information is analyzed (generally by a computer), and the system then attempts to make corrections to the web speed or the tension on the web to seek to bring the images on the web back into registration.

The prior systems, presently in use by the art, tend to be relatively expensive, not only in terms of the equipment that is needed to sense the mis-register and control the web, but also due to the cost of the side marginal edge of the web, that is needed for printing the information to be sensed, since generally this edge must be discarded after printing. Further, when a different image is to be printed on a press, the sensors must be repositioned at the same time as the rolls in the press are changed. This adds to the press set up time. Moreover, the presently used systems, even those employing state of the art equipment, still do not avoid some image mis-register. A typical example of such mis-register, that heretofore had to be tolerated by the art, is 0.06 inch.

In 1973, one of the inventors herein, John R. Martin, postulated six rules for controlling image registration on a moving web. According to these rules, print-to-print or cut-to-print registration is maintainable: (1) if all web drive points are non-slip; (2) if the web is uniform within spans; (3) if the web in any span is not subject to any intermediate forces; (4) if "gains" with respect to the web are reasonable; (5) if all drive points have a constant relative speed; and (6) if the web path between nips is constant. The last rule, rule 6, can be satisfied where all the drive and idler rolls are permanently located if the tension of the web entering the first printing station is constant. While the theoretical basis for these Martin rules was and remains sound, manufacturing a web-fed rotogravure printing press that will satisfy the requirements of these rules has not heretofore been possible.

SUMMARY OF THE INVENTION

In principal aspect, the present invention differs from prior registration systems in that the print-to-print and/or cut-to-print image registration system and method of the present invention prevents register errors from occurring in the first place while as noted, the prior systems attempt to correct mis-register errors after they have occurred and have been sensed. The present invention is useable with any type of web handling apparatus where print-to-print and/or cut-to-print image registration is important and where the moving web passes around deformable nip rolls or other deformable members. It is, however, particularly useful with web fed rotogravure printing presses.

An investigation of the mis-register problem disclosed that image mis-register is due to the bulging of the rubber surface of the impression rollers typically employed in rotogravure printing presses, assuming, of course, that the six above noted Martin rules are otherwise satisfied. The impression rolls are pressed or loaded against the steel printing cylinders such that the relatively soft rubber surface is deformed at the nip of each of the printing stations. The deformations are, in general, not uniform circumferentially, entry-to-exit or even station to station. Since the moving web must follow the rubber deformations, it is forced into variable speed conditions. Such conditions violate Martin's rule No. 5 and thus provide an explanation as to why mis-register is occurring.

Based on this discovery of the source of the mis-register problem, the present invention affords an elegant, practical, relatively inexpensive and in hindsight, relatively simple solution of the problem. Use of the present invention may reduce image mis-register by more than fifty times as compared to currently accepted tolerances.

Accordingly, it is a principal object of the present invention to provide an improved web handling apparatus having an improved print-to-print or cut-to-print print image registration system and method wherein the improved system and method prevent image positioning errors from occurring as opposed to sensing mis-register errors after they have occurred and then attempting to correct the sensed errors.

Another object of the present invention is to provide an improved web handling apparatus having an improved print-to-print or cut-to-print image registration system or method of the type described wherein superior registration between adjacent images printed on a moving web is achieved by driving a nip roll, that is disposed at a point upstream of and closely adjacent to the nip of the pair of nip rolls of a downstream printing or cutting station, at a speed equal to the speed of the nip rolls at that and the other stations in a multi-station press or apparatus. A related object of the present invention is to provide an improved web registration system or method of the type described wherein the length of the span between the driven nip roll and the nip of its adjacent station in a multi-station press or apparatus is relatively short, as compared to the length of the span of the moving web between the nip of the immediate upstream station and the nip of that adjacent station, whereby speed variations of the moving web along that relatively short span will not result in any significant mis-register of the images printed on the moving web as the images pass through the nip of that adjacent station.

Still another object of the present invention is to provide an improved web handling apparatus, such as a multi-station rotogravure printing press, having an improved system for controlling the print-to-print or cut-to-print registration of printed images on a moving web passing through a multi-station apparatus wherein a first station includes a first pair of nip rolls that are driven at a preselected speed and that perform a first printing operation on the moving web by printing a series of regularly spaced, repeated images on the moving web; wherein the moving web thereafter spans and passes to a second station which is spaced a predetermined distance from the first station and which includes a second pair of nip rolls that are adapted to perform a second operation, such as printing, cutting or the like, on the moving web as it passes therebetween, and that are driven at the same preselected speed as the first pair of nip rollers; wherein the successful performance of the second operation is dependent upon an image being positioned at evenly spaced intervals, with respect to adjacent images, as the image passes between the second pair of nip rolls; wherein at least one of the rolls of each of the pairs of nip rolls of the first and second stations has a cylindrical surface which deforms when the nip rolls are forced against each other as the web passes therebetween; wherein a driven nip roll is disposed adjacent to and upstream of the nip of the second pair of nip rolls so that the length of the span of the moving web between the driven nip roll and the nip of the second pair of nip rolls is relatively short, as compared to the length of the span of the moving web between the nip of the first pair of nip rolls and the nip of the second pair of nip rolls; and wherein means are employed for driving the driven nip roll at a speed equal to the preselected speed at which the first pair of nip rolls are driven. A related object of the present invention is to provide an improved print-to-print or cut-to-print image registration system of the type described wherein the moving web passes through a plurality of other print stations that are disposed along the path of the moving web between the first and second stations and that are arranged so that the moving web passes through them in a series, and with each being spaced a predetermined distance from adjacent stations; wherein each of the other stations contains a pair of nip rolls that are driven at the same preselected speed as the first pair of nip rolls and that perform a printing operation with respect to an image on the moving web as the moving web passes therebetween; wherein the successful performance of the printing operation at each other station is dependent on an image being positioned, along the moving web, at evenly spaced intervals with respect to adjacent images as the image passes through the nip of the nip rolls of that other station; wherein a driven roll is disposed adjacent to and upstream of the nip of each of the other stations so that in each of the other stations, the length of the span of the moving web between its driven nip roll and the nip of its pair of nip rolls is relatively short as compared to the length of the span of the moving web between the roll of the pairs of driven rolls of the immediately upstream station and the nip of its pair of nip rolls; and wherein each of these driven nip rolls is driven at a speed equal to the preselected speed at which the first pair of nip rolls is driven.

Yet another object of the present invention is to provide an improved method for controlling the print-to-print or cut-to-print registration of a plurality of regularly spaced, repeated images printed on a moving web when the moving web passes between the nip of a first pair of nip rolls of a first, downstream station that is adapted to perform an operation, such as printing, cutting and the like, on the moving web as the web passes there between, wherein the improved method includes the steps of printing the images on the moving web as the moving web passes between an upstream pair of nip printing rolls of an upstream printing station where the upstream station and the first station are spaced apart a predetermined distance; driving the upstream pair of nip rolls at a preselected speed as the moving web passes therebetween; driving the first pair of nip rolls at the same preselected speed as the upstream pair of nip rolls; and driving a driven roll at a speed equal to the speed at which the upstream pair of nip rolls are driven while maintaining the driven roll in a position adjacent to and upstream of the nip of the first pair of nip rolls so that the length of the span of the moving web between the driven roll and the nip of the first pair of nip rolls is relatively short, as compared to the length of the span of the moving web between the nip of the first pair of nip rolls and the roll of the upstream pair of driven rolls. A related object of the present invention is to provide an improved registration method of the type described which includes the steps of sensing the speed at which the upstream pair of nip rolls are being driven; and driving the driven roll at a speed equal to the sensed speed.

These and other objects, advantages and benefits of the present invention will become apparent to those skilled in this art from the following description of the preferred embodiment of the present invention.

DESCRIPTION OF THE PREFERRED EMBODIMENT

Figure 1:
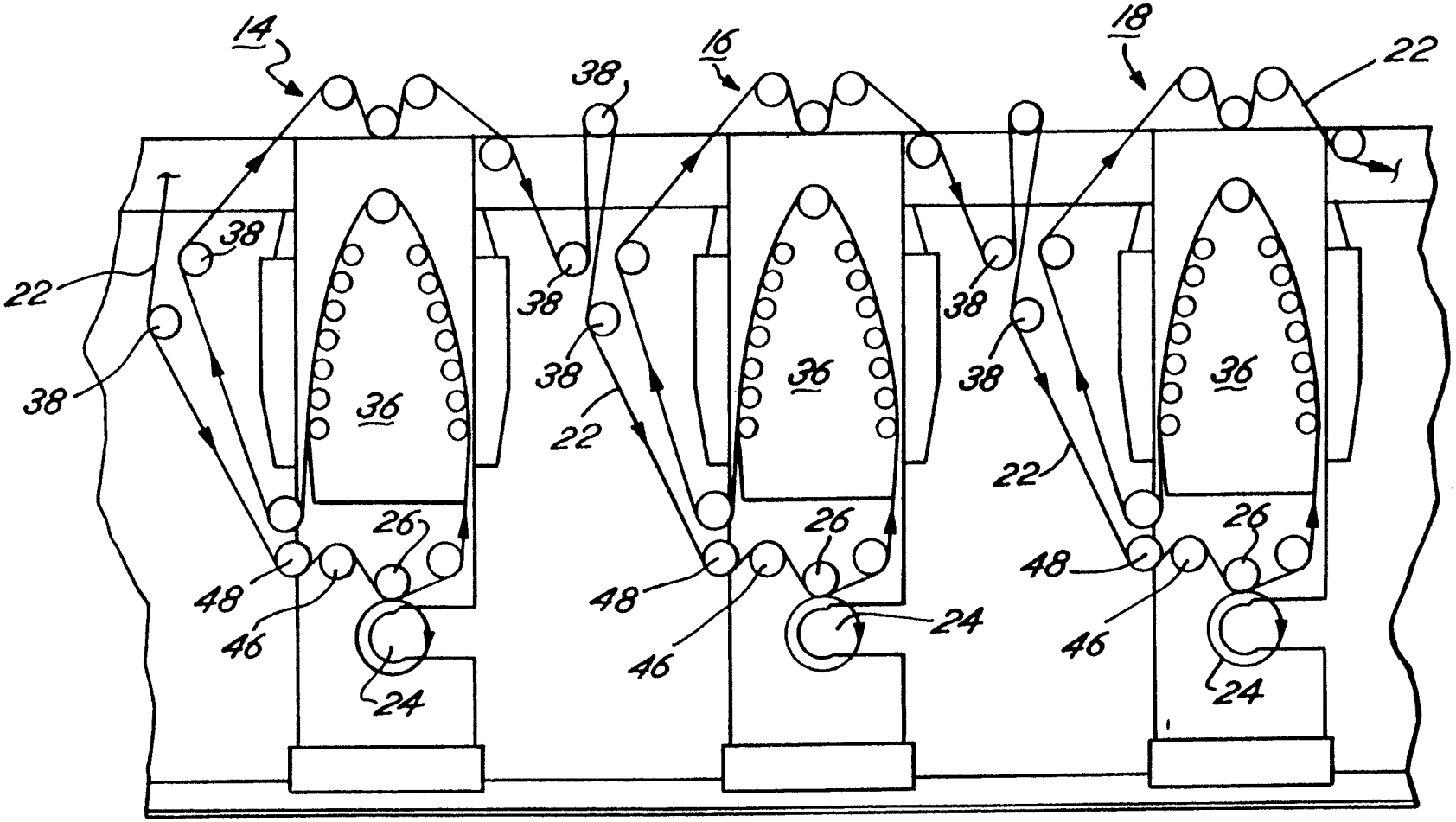
FIG. 1 is a partial, side elevational view of a multi-station, web fed rotogravure printing press showing three of its downstream printing stations.

Referring now to FIG. 1, a multi-station, web-fed rotogravure printing press is shown generally at 12. This press includes a number of substantially identical printing stations, three of which are shown at 14, 16 and 18 in FIG. 1. The press 12 is of a conventional design and functions in a conventional manner except as noted hereinbelow.

The press includes an initial printing station, not shown, which is upstream (to the left as shown in FIG. 1) from station 14 and to which a moving web 22 is fed, for example, from rolls of web stock. As is conventional, information is printed on the moving web at the initial printing station in the form of, for example, writing, graphics, artwork or other images (hereinafter generically referred to as an "image").

A series of such images is repeatedly printed, at regularly spaced intervals, on the moving web 22 as the web passes between the nip of the pair of nip rolls of the initial station. When the press 12 is used to print multicolor images, as for example, when the web being printed will be used as packaging for a product, a different color ink is printed (that is, added to the image) on the web at each of the print stations, including the stations 14–18.

As noted, the images are repeatedly printed in the initial printing station so that there is a regular, preselected spacing between adjacent images. This spacing or positioning of the images must be maintained, as precisely as possible, as the moving web 22 passes through the nips of the pairs of nip rolls of the other printing stations in the press 12, and additionally, through the nip of the pair of nip rolls of any web cutting station that may be positioned as the last station in the press. Print-to-print or cut-to-print registration (that is, maintaining a precise positioning of an image with respect to its adjacent images on the moving web 22) is important if high quality printing (and cutting) is to be achieved on the press 12.

Figure 2:
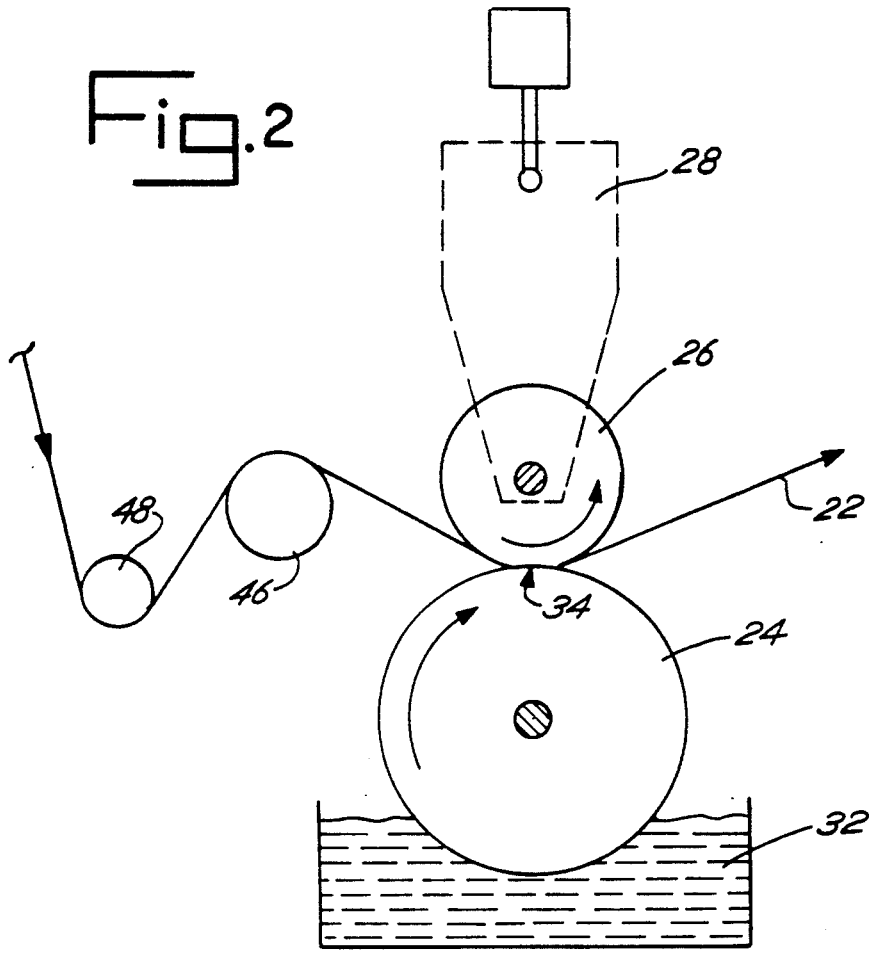
FIG. 2 is a simplified, enlarged view of portion of one of the printing stations of FIG. 1 and showing the relationship of the impression cylinder, the printing cylinder and the driven nip roll.
Figure 4:
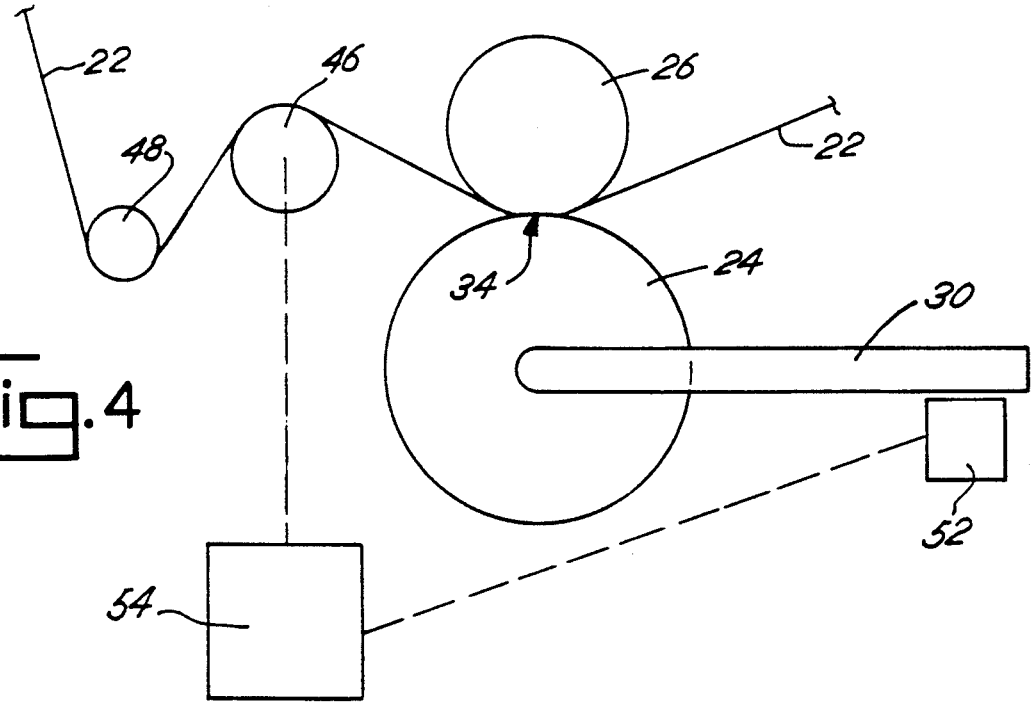
FIG. 4 is a view similar to that of FIG. 2, and showing the means used to sense the speed of the nip rolls of the printing stations and to drive the driven roll.

Each of the stations, including the printing stations 14–18, of the rotogravure press 12 employs a pair of nip rolls. The moving web 22 is nipped as it passes between the pair of nip rolls. At the print stations, such as stations 14–18, one of the nip rolls is a steel printing cylinder 24 that has been copper etched and chrome plated. As best illustrated in FIGS. 1, 2 and 4, the other roll of the pair of nip rolls is a hard-rubber covered impression roller 26. The printing cylinder 24 is positioned directly below the impression roller 26 in each of the stations. Pneumatic or hydraulic cylinders, shown generally at 28 in FIG. 2, are used to load (or press) the cylindrical outer surface of the impression roller 26 against the web and in turn against the cylindrical outer surface of the printing cylinder 24. The moving web 22, which may consist of paper, film or any of a wide variety of other materials to be printed, passes and as noted, is nipped between the printing cylinder 24 and the impression roller 26 as best shown in FIGS. 1, 2 and 4.

The pairs of nip rolls (that is, the printing cylinders and impression rollers) of the stations in the rotogravure press 12 are linked mechanically together by a conventional, common line-driveshaft, indicated generally at 30 in FIG. 4. Because of this mechanical linkage, each of these pairs of nip rolls of the downstream stations are driven at the same speed as the pair of nip rolls of the initial station.

Only one color of ink is printed at each gravure printing station. Each printing cylinder 24 includes one or more image engraving (not shown) regularly spaced about its outer cylindrical surface. The ink is applied to the image engraving on the printing cylinder by having part of the periphery of the cylinder 24 immersed in an ink bath 32. The ink thus applied to the image engraving on the cylinder 24 is transferred, as printed images, to the web 22 as it passes the nip, indicated generally at 34, between the impression roller 26 and the printing cylinder 24.

After the moving web 22 has passed the nip 34 of a print station, as for example station 14, the moving web next passes through a conventional drier section 36 of the station 14 where the inked images, applied by the nip rolls, are dried. Specifically, the moving web 22 passes around a plurality of idler rolls, in a conventional manner, as it passes through the drier section 36. Each printing station has its own drier section 36.

After the drier section, the moving web then passes, through a series of additional idler rolls 38, to the next adjacent downstream station, as for example, station 16, where it then proceeds to be passed between the nip of the nip rolls, that is, the printing cylinder 24 and impression roller 26, of printing station 16. Another-colored ink is applied to the images on the moving web at that station, still another color at station 18, and so forth at each printing station, with the web traveling through a drier section 36 between each application of an ink.

Figure 3:
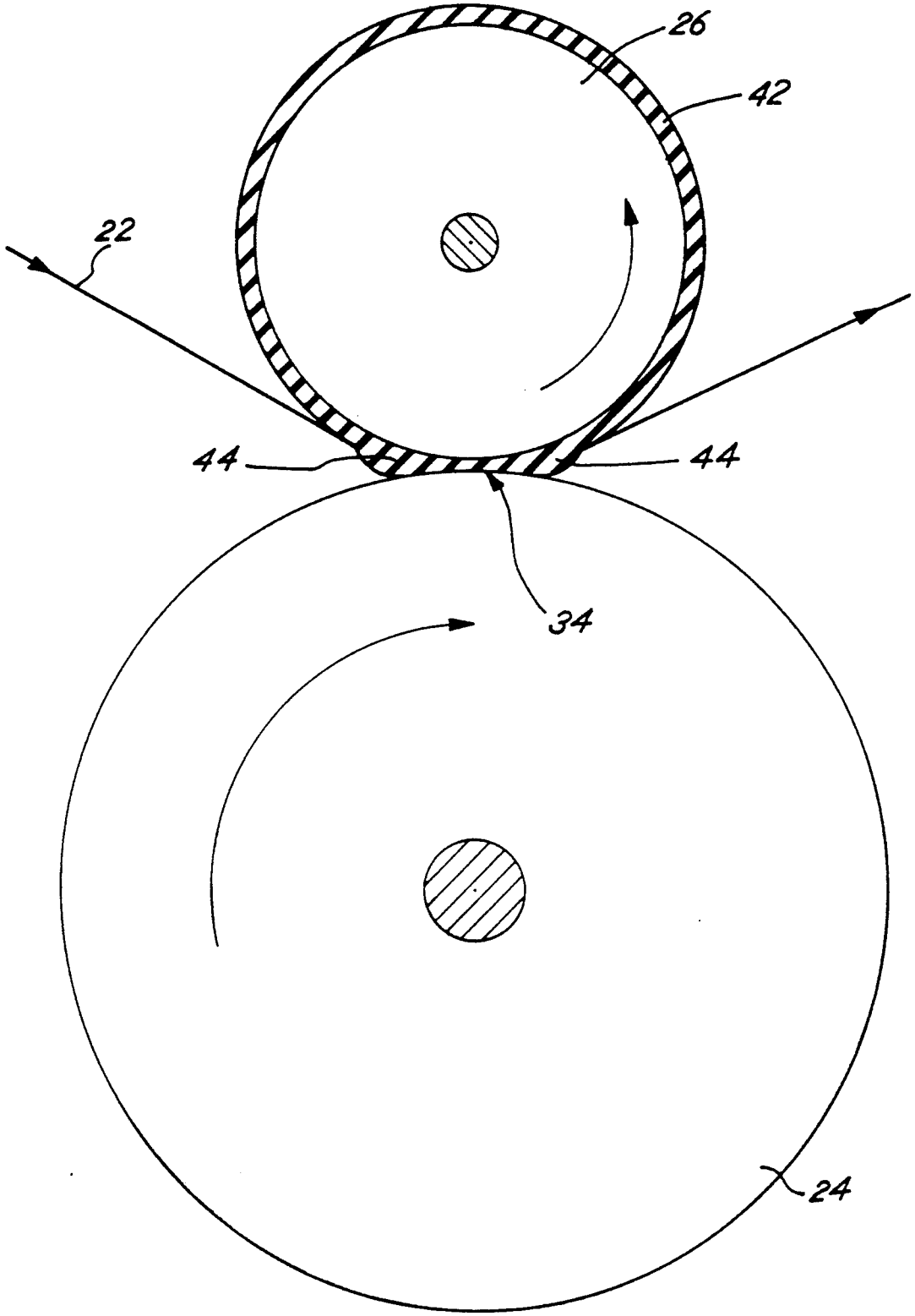
FIG. 3 is a further enlarged, exaggerated view of the nip of the impression roll and the printing cylinder shown in FIG. 2.

Although the nip rolls of all of the printing stations are mechanically linked together, experience discloses that images, which are initially printed with a predetermined spacial relationship one to another, tend not to stay in their initially printed relative positions one to another. As noted above, and as particularly illustrated in FIG. 3, it has been discovered, after investigation and analysis, that image mis-register is due to the fact that the relatively soft rubber-covering 42 on the impression rollers 26 deforms at the nip 34. Because the rubber used in the covering 42 is relatively incompressible (that is, has a constant density), it is forced to bulge out at the entry and exit points of each nip 34. These bulges, indicated generally at 44, will generally not be uniform circumferentially or on the entry and exit sides of the bulge. Similarly the bulges 44 tend not to be uniform from printing station to printing station. Since the moving web 22 must follow the rubber-bulges 44, it is forced into variable speed conditions as it passes through the nips 34 of the pairs of nip rolls and continue in contact with the bulges 44. It is believed that the speed variations induced by the rubber-bulges 44, together with the relatively long spans over which the web 22 must travel (including travel through the drier section 36) between the nips 34 of adjacent stations, is the cause of mis-register problems, assuming, of course, that none of the other of Martin's six rules are violated.

To minimize, or to overcome as a practical matter, the effects of the speed variations induced by the rubber-bulges 44, a driven roll 46 is disposed or positioned, as illustrated in FIGS. 1, 2 and 4, upstream from and as closely adjacent as practicable to the nip 34 of each station of the press 12, except, of course, the initial, first printing station. At each station, an additional, adjacent, upstream idler roll 48 could be used to suitably friction-wrap the web 22 around the driven roll 46 so as to achieve a satisfactory positive drive of the web about the roll 46.

The roll 46 is driven, as described below, at a speed equal to the speed of the pairs of nip rolls of the station with which it is associated. The speed of this pair of nip rolls is, of course, the same as the speed of the nip rolls of the initial, upstream print station due to the mechanical linkage between the pairs of nip rolls.

The theory underlying the positioning of a driven roll 46 upstream and closely adjacent to each of the nips 34 is based on the recognition that relative position-changes of images on a moving web are directly proportional to the length of the span between driven nips and the speed variation of the web in the span. Thus, by making the span between the station 16 and its associated, adjacent, upstream driven nip roll 46 as short as practicable (relative to the length of the span between the nip 34 of the station 16 and the nip 34 of the station 14), speed variations in the web 22 induced by the bulges 44 will not have any material or significant effect on the relative positions of adjacent printed images as those images pass the nip 34 of the station 16. In this regard, the length of the span between the driven roll 46 and the nip 34 of the station 16 may be as small as about twelve inches while the length of span between the nips 34 of stations 14 and 16 may typically be as long as from three hundred and sixty to six hundred inches. In other words, the ratio of the length of the span between the nips 34 of adjacent stations and the length of the span between the roll 46 and its adjacent nip 34 may be of the order of 30 to 1 and higher. By using the driven rolls 46, mis-register or mis-positioning of the adjacent images on the moving web 22 may thus be reduced to the order of 0.0012 inch, as compared with the currently tolerated mis-register of 0.60 inch. Specifically, a reduction of the magnitude of mis-register of about 50 to 1 may be achieved by the use of the present invention.

In the rotogravure press 12, the speed of the nip rolls may be sensed by a conventional incremental shaft encoder, shown generally at 52, that is associated with the line shaft 30 of the press. Such an optical encoder 52 is Part No. 44A963255-G01 manufactured by BEI Motion Systems Incorporated of Carlsbad, Calif. As shown in FIG. 4, the encoder 52 is disposed adjacent to the line shaft 30, in a conventional manner, so as to sense the speed of that shaft.

A conventional AC servo drive, AC motor and controller are associated with the encoder 52 and with each of the driven rolls 46. Specifically, the operation of the AC servo drive and AC motor is controlled by a controller based on the signals received from the encoder 52. The AC motor is connected with the driven roll 46 and serves to drive the roll 46 at the same speed as the nip rolls of the press 12 are being driven.

The AC servo drive, AC motor and controller are all conventional components and are shown collectively at 54 in FIG. 4. Such a combined AC servo drive and AC motor is the Model AC-200 manufactured by the General Electric Company. The controller is Model "Sam-Plus" manufactured by Creonics, Incorporated of Lebanon, N.H.

The preferred embodiment of the present invention has now been described. This preferred embodiment constitutes the best mode now contemplated by the inventors for carrying out their inventions. Their invention, however, can be used with web handling apparatus other than the described rotogravure press and because their invention may be copied without copying the precise details of the preferred embodiment, the following claims particularly point out and distinctly claim the subject matter which the inventors regard as their invention and wish to protect.

We claim:

1. In a web handling apparatus for a moving web that travels along a predetermined path of travel in the web handling apparatus and that is adapted to have high quality, multi-color images printed thereon at relatively high speeds in the web handling apparatus; and where the web handling apparatus includes: a first upstream station having a first pair of nip rolls that are driven at a preselected, constant speed and that print a series of regularly spaced, repeated images on the moving web as the moving web passes between the nip of the first pair of nip rolls, with at least one of the rolls of the first pair of nip rolls having a cylindrical surface which deforms when the first pair of nip rolls are forced against each other as the moving web passes therebetween; and a second station positioned downstream, along the path of travel of the moving web, from the first station and having a second pair of nip rolls that are driven at the preselected, constant speed and that perform a second, selectively one of a printing operation and a cutting operation with respect to the images, which were printed on the moving web usptream from the second station, as the moving web passes between the nip of the second pair of nip rolls of the second station, with at least one of the rolls of the second pair of nip rolls having a cylindrical surface which deforms when the second pair of nip rolls are forced against each other as the moving web passes therebetween, with the second pair of nip rolls of the second station being positioned so that the moving web passes over a relatively long span, along its path of travel, between the nip of the first pair of nip rolls of the first station and the nip of the second pair of nip rolls of the second station, and with the successful performance of the second operation being dependent on the images being positioned, along the moving web, at evenly spaced intervals, with respect to their adjacent images, as the images pass between the nip of the second pair of nip rolls of the second station, the improvement comprising a system that controls the print-to-print or print-to-cut registration of the images printed on the moving web and that functions, independently of any sensing of the tension condition of the moving web and of any attempt to change the web tension condition of the moving web in response to sensed web tension conditions, this improved registration system comprising:

a driven nip roll that is disposed adjacent to and upstream of the nip of the second pair of nip rolls of the second station so that the driven nip roll is adapted to drive the moving web as the moving web passes about the driven nip roll and so that the length of the span of the moving web between the driven nip roll and the nip of the second pair of nip rolls of the second station is short, as compared to the length of the span of the moving web between the nip of the first pair of nip rolls of the first station and the nip of the second pair of nip rolls of the second station; and means for driving the driven nip roll so that the driven nip roll continuously drives the moving web, as the moving web passes about the driven nip roll, at a speed that is the same as the preselected speed at which the first and second pairs of nip rolls are being driven, with the operation of the driving means being independent of any sensing of the tension condition of the moving web and of any attempt to correct variations of the tension condition of the moving web.

2. The improved registration system of claim 1 which includes means for sensing the speed at which the first pair of nip rolls of the first station are being driven; and which also includes means for controlling the driving means in response to the sensed speed of the first pair of nip rolls of the first station.

3. The improved registration system of claim 1 wherein the ratio of the length of the span of the moving web, between the nip of the first pair of nip rolls of the first station and the nip of the second pair of nip rolls of the second station, to the length of the span of the moving web, between the driven nip roll and the nip of the second pair of nip rolls of the second station is about thirty to one.

4. The improved registration system of claim 1 wherein a plurality of other printing stations are positioned, along the path of travel of the moving web, between the first station and the second station and are arranged so that the moving web passes through each of the other stations, in series, along its path of travel, with the other stations being positioned, relative to each other and relative to the first and second stations, such that the moving web passes over a long span, along its path of travel, between adjacent stations; wherein each of the other stations includes a pair of nip rolls that are driven at the preselected speed and that perform a printing operation with respect to the images on the moving web as the moving web passes therebetween; wherein at least one of the rolls of each of the pairs of nip rolls of each of the other stations has a cylindrical surface which deforms when the pair of rolls are forced against each other as the moving web passes therebetween; wherein the successful performance of the printing operation at any one of the other stations depends on the images being positioned, along the moving web, at evenly spaced intervals, with respect to adjacent images, as the images pass through the nip rolls of the one other station; wherein a driven nip roll is disposed adjacent to and upstream of the nip of each pair of nip rolls of each one of the other stations so that each driven nip roll is adapted to drive the moving web as the moving web passes about the driven nip roll and so that at each one of the other stations, the length of the span of the moving web between the driven nip roll and the nip of the pair of nip rolls of the one other station is relatively short, as compared to the length of the span of the moving web between the nip of the pair of nip rolls of the one other station and the nip of the pair of nip rolls of the station immediately upstream from the one other station; and which includes means for driving each of the driven nip rolls at each of the other stations so that each driven nip roll continuously drives the moving web, as the moving web passes about the driven nip roll, at a speed that is the same as the preselected speed at which pairs of nip rolls are being driven, with the operation of the driving means being independent of any sensing of the tension condition of the moving web and of any attempt to correct variations of the tension condition of the moving web.

5. The improved registration system of claim 4, wherein the first pair of nip rolls of the first station and the pairs of nip rolls of the other stations each include: an impression roll having an outer rubber cylindrical surface and a cylinder roll having a relatively harder outer cylindrical surface; and wherein means are disposed at each of the stations for forcing the cylindrical surfaces of the impression roll and the cylinder roll, at the station, together during the operation of the station.

6. The improved registration system of claim 5 which includes means for sensing the speed at which the first pair of nip rolls of the first station are being driven; and which also includes means for controlling the driving means for all of the driven nip rolls in response to the sensed speed of the first pair of nip rolls of the first station.

7. The improved registration system of claim 6 wherein the ratio of the length of the span of the moving web, between the nip of the pair of nip rolls of one station and the nip of the pair of nip rolls of the next station, immediately adjacent to the one station along the path of travel of the moving web, to the length of the span of the moving web, between the driven nip roll and the nip of the pair of nip rolls of the next station, is about thirty to one.

8. An improved method that is for controlling the print-to-print or cut-to-print registration of images printed on a moving web and whose performance is independent of sensing the tension condition of the moving web and of attempting to change the web tension condition in response to a sensed tension condition, where the moving web travels along a predetermined path of travel in a web handling apparatus that is adapted for printing high quality, multi-colored images at relatively high speeds on the moving web, and where the web handling apparatus includes: a first, upstream station having a first pair of nip rolls for receiving the moving web therebetween, with at least one of the rolls of the first pair of nip rolls having a cylindrical surface which deforms when the first pair of nip rolls are forced against each other as the moving web passes therebetween; and a second, downstream station having a second pair of nip rolls for receiving the moving web therebetween, with at least one of the rolls of the second pair of nip rolls having a cylindrical surface which deforms when the second pair of nip rolls are forced against each other as the moving web passes therebetween, the improved method including the steps of:

passing the moving web between the nip of the first pair of nip rolls of a first station;

driving the first pair of nip rolls of the first station at a constant, preselected speed as the moving web passes therebetween;

printing a series of regularly spaced, repeated images on the moving web as the moving web passes between the nip of the first pair of nip rolls of the first station;

passing the moving web along a long span along its path of travel between the nip of the first pair of nip rolls of the first station and the nip of the second pair of nip rolls of the second station;

passing the moving web between the nip of the a second pair of nip rolls of a second, downstream station;

passing the moving web about a driven nip roll that is disposed adjacent to and upstream of the nip of the second pair of nip rolls of the second station so that the driven nip roll is adapted to drive the moving web and so that the length of the span of the moving web between the driven roll and the nip of the second pair of nip rolls of the second station is short, as compared to the length of the span of the moving web between the nip of the first pair of nip rollers of the first station and the nip of the second pair of nip rolls of the second station; and driving the second pair of nip rolls of the second station at the constant preselected speed as the moving web passes therebetween;

driving the driven nip roll so that the driven nip roll continuously drives the moving web at the same speed as the preselected speed at which the first and second pairs of nip rolls are being driven, as the moving web passes about the driven nip roll, and so that the driving of the driven nip roll is independent of any sensing of the tension condition of the moving web and of any attempt to correct variations of the tension condition of the moving web; and performing a second, selectively one of a printing and cutting operation with respect to an image printed on the moving web, as the moving web passes between the nip of the second pair of nip rolls of the second station, with the successful performance of the second operation being dependent on the images being positioned, along the moving web, at evenly spaced intervals with respect to adjacent images, as the images pass between the nip of the second pair of nip rolls of the second station.

9. The improved registration method of claim 8 which includes the step of sensing the speed at which the upstream pair of nip rolls of the upstream station are being driven nip; and driving the driven roll at a speed equal to the sensed speed.

10. The improved method of claim 8 wherein the web handling apparatus also includes a plurality of other printing stations positioned, along the path of travel of the moving web, between the first and second stations, with the other stations being arranged so that the moving web passes through each of the other stations, in series, along its path of travel and with each of the other stations being positioned relative to each other and relative to the first and second stations such that the moving web passes over a relatively long span, along its path of travel, between adjacent stations; wherein each of the other stations includes a pair of nip rolls that are driven at the constant, predetermined speed and that perform a printing operation with respect to the images on the moving web as the moving web passes therebetween; wherein at least one of the rolls of each of the pairs of nip rolls of each of the other station has a cylindrical surface which deforms when the pair of rolls are forced against each other as the moving web passes therebetween; wherein a driven nip roll is disposed adjacent to and upstream of the nip of the pair of nip rolls of each one of the other stations so that at each one of the other stations, each driven nip roll is adapted to drive the moving web as the moving web passes about the driven nip roll and so that the length of the span of the moving web between the driven nip roll and the nip of its pair of nip rolls is relatively short as compared to the length of the span of the moving web between the nip of the pair of nip rolls of the one other station and the nip of the pair of nip rolls of the station immediately upstream from the one other station; and which include the additional steps of: passing the moving web through the nip of the nip rolls of each of the other stations; passing the moving web about each of the driven nip rolls at each of the other stations; and driving the driven nip rolls at each of the other stations so that each of the driven nip rolls continuously drives the moving web at a speed equal to the preselected speed, at which the pairs of nip rolls are being driven, and independently of any sensing of the tension conditions of the moving web and of any attempt to correct variations of the tension condition of the moving web.

11. The improved method of claim 10 which includes the step of printing a series of regularly spaced, repeated images on the moving web as the moving web passes between the nip of the pairs of nip rolls of the other printing stations.

12. The improved method of claim 10 which includes the steps of sensing the speed at which the first pair of nip rolls of the first station are being driven; and driving the driven nip rolls of the second and the other stations in response to the sensed speed of the first pair of nip rolls of the first station.

13. An improved web handling apparatus for printing high quality, multi-colored, in-register images on a moving web that travels, at relatively high speed, along a predetermined path of travel, the improved apparatus comprising:

a first, upstream printing station including a first pair of nip rolls that are driven at a constant, preselected speed and that print a series of regularly spaced, repeated images on the moving web as the moving web passes between the nip of the first pair of nip rolls, with at least one of the rolls of the first pair of nip rolls having a cylindrical surface which deforms when the first pair of nip rolls are forced against each other as the moving web passes therebetween;

a second, downstream station including a second pair of nip rolls that are driven at the constant preselected speed and that perform a second, selectively one of a printing and cutting operation with respect to the images which were printed on the moving web upstream from the second station, as the moving web passes between the nip of the second pair of nip rolls, with at least one of the rolls of the second pair of nip rolls having a cylindrical surface which deforms when the second pair of nip rolls are forced against each other as the moving web passes therebetween, with the moving web passing over a long span, along its path of travel, between the nip of the first pair of nip rolls of the second station, and with the successful performance of the second operation performed at the second station being dependent on the images being positioned at evenly spaced intervals, along the moving web, with respect to adjacent images as the images pass between the nip of the second pair of nip rolls of the second station;

a driven nip roll that is disposed adjacent to and upstream of the nip of the second pair of nip rolls of the second station so that the driven nip roll is adapted to drive the moving web, as the moving web passes about the driven nip roll, and so that the length of the span of the moving web between the driven nip roll and the nip of the second pair of nip rolls of the second station is short, as compared to the length of the span of the moving web between the nip of the first pair of nip rolls of the first station and the nip of the second pair of nip rolls of the second station; and means for driving the driven nip roll so that the driven nip roll continuously drives the moving web, as the moving web passes about the driven nip roll, at a speed that is the same as the constant preselected speed at which pairs of nip rolls are being driven, with the operation of the driving means being independent of any sensing of the tension condition of the moving web and of any attempt to correct variations of the tension condition of the moving web.

14. The improved web handling apparatus of claim 13 which includes means for sensing the speed at which the first pair of nip rolls of the first station are being driven; and which also includes means for controlling the driving means in response to the sensed speed of the first pair of nip rolls of the first station.

15. The improved web handling apparatus of claim 13 wherein the ratio of the length of the span of the moving web, between the nip of the pair of nip rolls of the first station and the nip of the second pair of nip rolls of the second station, to the length of the span of the moving web between the driven nip roll and the nip of the second pair of nip rolls of the second station is about thirty to one.

16. The improved web handling apparatus of claim 13 wherein a plurality of other printing stations are positioned, along the path of travel of the moving web, between the first station and the second station and are arranged so that the moving web passes through each of the other stations, in series, along its path of travel, and with the other stations being positioned, relative to each other and relative to the first and second stations, such that the moving web passes over a long span, along its path of travel, between adjacent stations; wherein each of the other stations includes a pair of nip rolls that are driven at the constant, predetermined speed and that perform a printing operation with respect to the images on the moving web as the moving web passes therebetween; wherein at least one of the rolls of each of the pairs of nip rolls of each of the other station has a cylindrical surface which deforms when the pair of nip rolls is forced against each other as the moving web passes therebetween; wherein the successful performance of the printing operation at any one of the other stations depends on the images being positioned, along the moving web, at evenly spaced intervals, with respect to adjacent images, as the images pass through the nip of the nip rolls of the one other station; wherein a driven nip roll is disposed adjacent to and upstream of the nip of the pair of nip rolls of each one of the other stations so that each driven nip roll is adapted to drive the moving web, as the moving web passes about the driven nip roll, so that at each one of the other stations, the length of the span of the moving web between the driven nip roll and the nip of the pair of nip rolls of the one other station is short, as compared to the length of the span of the moving web between the nip of the pair of rolls of the one other station and the nip of the pair of nip rolls of the station immediately upstream from the one other station; and which includes means for driving each of the driven nip rolls so that each driven nip roll continuously drives the moving web, as the moving web passes about the driven nip roll, at a speed that is the same as the constant preselected speed at which pairs of nip rolls are being driven, with the operation of the driving means being independent of any sensing of the tension condition of the moving web and of any attempt to correct variations of the tension condition of the moving web.

17. The improved web handling apparatus of claim 16 wherein the first pair of nip rolls of the first station and the pairs of nip rolls of the other stations each include: an impression roll having an outer rubber cylindrical surface and a cylinder roll having a relatively harder outer cylindrical surface; and wherein means are disposed at each of the stations for forcing the cylindrical surfaces of the impression roll and the cylinder roll, at that station, together during the operation of the station.

18. The improved web handling apparatus of claim 17 which includes means for sensing the speed at which the first pair of nip rolls of the first station are being driven; and which also includes means for controlling the driving means for all the driven rolls in response to the sensed speed of the first pair of nip rolls of the first station.

19. The improved web handling apparatus of claim 18 wherein the ratio of the length of the span of the moving web, between the nip of the pair of nip rolls of one station and the nip of the pair of nip rolls of the next station, immediately adjacent to the one station along the path of travel of the moving web, to the length of the span of the moving web, between the driven nip roll and the nip of the pair of nip rolls of the next station, is about thirty to one.

* * * * *

UNITED STATES PATENT AND TRADEMARK OFFICE

CERTIFICATE OF CORRECTION

PATENT NO. : 5,299,496
DATED : April 5, 1994
INVENTOR(S) : John R. Martin
Roger Cederholm It is certified that error appears in the above-identified patent and that said Letters Patent is hereby corrected as shown below:

Column 1, line 1: in the title, "Wen" should read Web.

Signed and Sealed this

Twentieth Day of September, 1994

*Attest:*

*Attesting Officer*

BRUCE LEHMAN

*Commissioner of Patents and Trademarks*